US010024131B2

(12) United States Patent
Tolman et al.

(10) Patent No.: US 10,024,131 B2
(45) Date of Patent: Jul. 17, 2018

(54) FLUID PLUGS AS DOWNHOLE SEALING DEVICES AND SYSTEMS AND METHODS INCLUDING THE SAME

(71) Applicants: Randy C. Tolman, Spring, TX (US); Timothy G. Benish, Conroe, TX (US); Geoffrey Steiner, Castle Rock, CO (US)

(72) Inventors: Randy C. Tolman, Spring, TX (US); Timothy G. Benish, Conroe, TX (US); Geoffrey Steiner, Castle Rock, CO (US)

(73) Assignee: ExxonMobil Upstream Research Company, Spring, TX (US)

( * ) Notice: Subject to any disclaimer, the term of this patent is extended or adjusted under 35 U.S.C. 154(b) by 346 days.

(21) Appl. No.: 14/437,161

(22) PCT Filed: Nov. 18, 2013

(86) PCT No.: PCT/US2013/070606
§ 371 (c)(1),
(2) Date: Apr. 20, 2015

(87) PCT Pub. No.: WO2014/099207
PCT Pub. Date: Jun. 26, 2014

(65) Prior Publication Data

US 2015/0292293 A1 Oct. 15, 2015

Related U.S. Application Data

(60) Provisional application No. 61/834,299, filed on Jun. 12, 2013, provisional application No. 61/745,140, filed on Dec. 21, 2012.

(51) Int. Cl.
*E21B 33/128* (2006.01)
*E21B 43/25* (2006.01)
(Continued)

(52) U.S. Cl.
CPC ..... *E21B 33/124* (2013.01); *E21B 33/12* (2013.01); *E21B 33/134* (2013.01);
(Continued)

(58) Field of Classification Search
CPC .... E21B 43/261; E21B 33/138; E21B 43/267; E21B 43/26; E21B 43/25
See application file for complete search history.

(56) References Cited

U.S. PATENT DOCUMENTS 3,010,514 A * 11/1961 Fox ..... E21B 33/134 166/284
3,180,416 A * 4/1965 Smith ..... C09K 8/72 166/281
(Continued)

OTHER PUBLICATIONS

Schlumberger Limited, "Falcon Hydraulic-Actuated Frac Valve," 2012, http://www.slb.com/resources/other_resources/product_sheets/completions/multistage_stimulation/hydraulic_actuated_frac_valve_ps.aspx.

*Primary Examiner* — Kipp C Wallace
(74) *Attorney, Agent, or Firm* — ExxonMobil Upstream Research Company—Law Department

(57) ABSTRACT

Fluid plugs as downhole sealing devices and methods include providing a stimulating fluid to a casing conduit that is defined by the production casing to stimulate a portion of a subterranean formation within which the production casing extends. The methods further may include providing a sealing fluid to the casing conduit, providing a sealing device to the casing conduit, and flowing the sealing fluid and the sealing device to a perforated section of the production casing. The methods further may include locating the sealing device on a perforation, generating a fluid plug within the perforated section of the production casing by increasing a viscosity of the sealing fluid, and retaining the sealing device proximate the perforation with the fluid plug.

26 Claims, 7 Drawing Sheets

(51) Int. Cl.

| | |
|---|---|
| ***E21B 33/124*** | (2006.01) |
| ***E21B 33/138*** | (2006.01) |
| ***E21B 33/134*** | (2006.01) |
| ***E21B 43/11*** | (2006.01) |
| ***E21B 33/12*** | (2006.01) |
| ***E21B 43/119*** | (2006.01) |
| ***E21B 43/14*** | (2006.01) |

(52) U.S. Cl.
CPC ..... *E21B 33/138* (2013.01); *E21B 43/11* (2013.01); *E21B 43/119* (2013.01); *E21B 43/14* (2013.01); *E21B 43/25* (2013.01)

(56) References Cited

U.S. PATENT DOCUMENTS 3,367,420 A * 2/1968 Jennings ..... E21B 33/134 166/276
3,713,486 A * 1/1973 Meitzen ..... E21B 33/138 166/277
4,893,676 A * 1/1990 Hill ..... E21B 43/267 166/153
5,178,219 A * 1/1993 Striech ..... E21B 33/124 166/127
5,234,055 A 8/1993 Cornette
5,579,844 A 12/1996 Rebardi et al.
5,704,426 A 1/1998 Rytlewski et al.
5,829,520 A 11/1998 Johnson
6,543,538 B2 4/2003 Tolman et al.
6,907,936 B2 6/2005 Fehr et al.
6,957,701 B2 10/2005 Tolman et al.
7,059,407 B2 6/2006 Tolman et al.
7,067,000 B1 * 6/2006 Szymanski ..... C04B 28/02 106/696
7,168,494 B2 1/2007 Starr et al.
7,353,879 B2 4/2008 Todd et al.
7,477,160 B2 1/2009 Lemenager et al.
7,516,792 B2 4/2009 Lonnes et al.
7,575,062 B2 8/2009 East, Jr.
7,735,559 B2 6/2010 Malone
7,798,236 B2 9/2010 McKeachnie et al.
8,167,047 B2 5/2012 Themig et al.
8,215,411 B2 7/2012 Flores et al.
8,220,542 B2 7/2012 Whitsitt et al.
8,237,585 B2 8/2012 Zimmerman
8,267,177 B1 9/2012 Vogel et al.
8,276,670 B2 10/2012 Patel
8,330,617 B2 12/2012 Chen et al.
8,347,982 B2 1/2013 Hannegan et al.
8,496,055 B2 7/2013 Mootoo et al.
2002/0007949 A1 * 1/2002 Tolman ..... E21B 33/124 166/308.1
2004/0084190 A1 5/2004 Hill et al.
2006/0118301 A1 6/2006 East, Jr. et al.
2008/0093073 A1 4/2008 Bustos et al.
2009/0032255 A1 2/2009 Surjaatmadja et al.
2009/0101334 A1 4/2009 Baser et al.
2009/0255674 A1 * 10/2009 Boney ..... E21B 33/138 166/284
2010/0084134 A1 4/2010 Tulissi et al.
2010/0122813 A1 * 5/2010 Trummer ..... E21B 33/138 166/255.1
2011/0048743 A1 3/2011 Stafford et al.
2011/0168403 A1 7/2011 Patel
2012/0043079 A1 2/2012 Wassouf et al.
2012/0085548 A1 4/2012 Fleckenstein et al.
2012/0090687 A1 4/2012 Grigsby et al.
2012/0111566 A1 5/2012 Sherman et al.
2012/0199349 A1 8/2012 Themig et al.
2012/0292053 A1 11/2012 Xu et al.
2013/0008648 A1 1/2013 Lovorn et al.
2013/0105159 A1 5/2013 Alvarez et al.
2013/0199790 A1 8/2013 Themig et al.
2013/0206425 A1 8/2013 Mazyar et al.
2013/0248174 A1 9/2013 Dale et al.

* cited by examiner

FLUID PLUGS AS DOWNHOLE SEALING DEVICES AND SYSTEMS AND METHODS INCLUDING THE SAME

CROSS-REFERENCE TO RELATED APPLICATIONS

This application is the National Stage of International Application No. PCT/US2013/070606, filed Nov. 18, 2013, which claims the benefit of U.S. Provisional Patent Application No. 61/745,140, filed Dec. 21, 2012, and U.S. Provisional Patent Application No. 61/834,299, filed Jun. 12, 2013, the disclosures of both are hereby incorporated by reference.

FIELD OF THE DISCLOSURE

The present disclosure is directed generally to fluid plugs as downhole sealing devices and more particularly to stimulation operations that utilize fluid plugs as downhole sealing devices.

BACKGROUND OF THE DISCLOSURE

A hydrocarbon well may be utilized to produce one or more reservoir fluids, such as liquid and/or gaseous hydrocarbons, from a subterranean formation. The hydrocarbon well may include a wellbore that extends between a surface region and the subterranean formation and a production casing that extends within the wellbore and defines a casing conduit.

During construction and/or operation of the hydrocarbon well, it may be desirable to temporarily and fluidly isolate an uphole portion of the casing conduit from a downhole portion of the casing conduit, such as to occlude, restrict, and/or block fluid flow, or fluid communication, between the respective portions of the casing conduit. Historically, this fluid isolation has been accomplished by locating a discrete downhole sealing device, such as a plug, bridge plug, swellable plug, and/or packer, within a target portion of the casing conduit. The discrete downhole sealing device is constructed from one or more solid materials and is typically located within the casing conduit by flowing from the surface region to the target portion of the casing conduit.

Often, a downhole assembly must be removed from the casing conduit prior to locating the discrete downhole sealing device therein, such as to provide clearance for the discrete downhole sealing device to flow to the target portion of the casing conduit. In addition, and subsequent to the temporary fluid isolation, it may be necessary to remove the discrete downhole sealing device from the casing conduit. Removal of the downhole assembly from the casing conduit and/or removal of the discrete downhole sealing device from the casing conduit may be time-consuming and expensive processes that increase the overall cost of construction and/or operation of the hydrocarbon well. Thus, there exists a need for improved downhole sealing devices.

SUMMARY OF THE DISCLOSURE

Fluid plugs as downhole sealing devices and systems and methods including the same are disclosed herein. The methods may include providing a stimulating fluid to a casing conduit that is defined by the production casing to stimulate a portion of a subterranean formation within which the production casing extends. The methods further may include providing a sealing fluid to the casing conduit, providing a sealing device to the casing conduit, and flowing the sealing fluid and the sealing device to a perforated section of the production casing. The methods further may include locating the sealing device on a perforation, generating a fluid plug within the perforated section of the production casing by increasing a viscosity of the sealing fluid, and retaining the sealing device proximate the perforation with the fluid plug.

The systems may include production casings, stimulation assemblies, wells, and/or subterranean formations that utilize, are utilized by, and/or are formed by the methods. The systems additionally or alternatively may be configured to perform and/or utilize the methods.

In some embodiments, the systems and methods include creating and/or opening the perforation in the production casing. In some embodiments, the perforation is created by a perforation device, such as a perforation gun, that is located within the casing conduit. In some embodiments, the systems and methods include flowing the sealing fluid at least partially concurrently with flowing the sealing device. In some embodiments, the fluid plug resists fluid flow through the perforated section of the production casing. In some embodiments, the sealing device is at least substantially, if not completely, immobilized within the fluid plug. In some embodiments, the systems and methods further include breaking the fluid plug, and in some embodiments the fluid plug is configured to break automatically.

In some embodiments, the systems and methods include timing the providing the sealing fluid and the providing the sealing device to regulate a fraction of a volume of the sealing fluid that flows through the perforation into the subterranean formation. In some embodiments, the fraction of the volume of the sealing fluid is less than an upper threshold fraction. In some embodiments, the fraction of the volume of the sealing fluid is greater than a lower threshold fraction. In some embodiments, at most a minority portion of the volume of sealing fluid flows through the perforation into the subterranean formation.

In some embodiments, the systems and methods include creating a plurality of perforations and/or a plurality of fractures. In some embodiments, the systems and methods include locating a plurality of sealing devices and/or retaining the plurality of sealing devices with a plurality of fluid plugs.

In some embodiments, the systems and methods include pressurizing the casing conduit prior to creating the perforation. In some embodiments, the systems and methods include determining that a fluid pressure within the casing conduit is greater than a threshold fluid pressure and creating the perforation responsive to the determining. In some embodiments, the sealing fluid includes a crosslinking gel solution.

DETAILED DESCRIPTION AND BEST MODE OF THE DISCLOSURE

Figure 1:
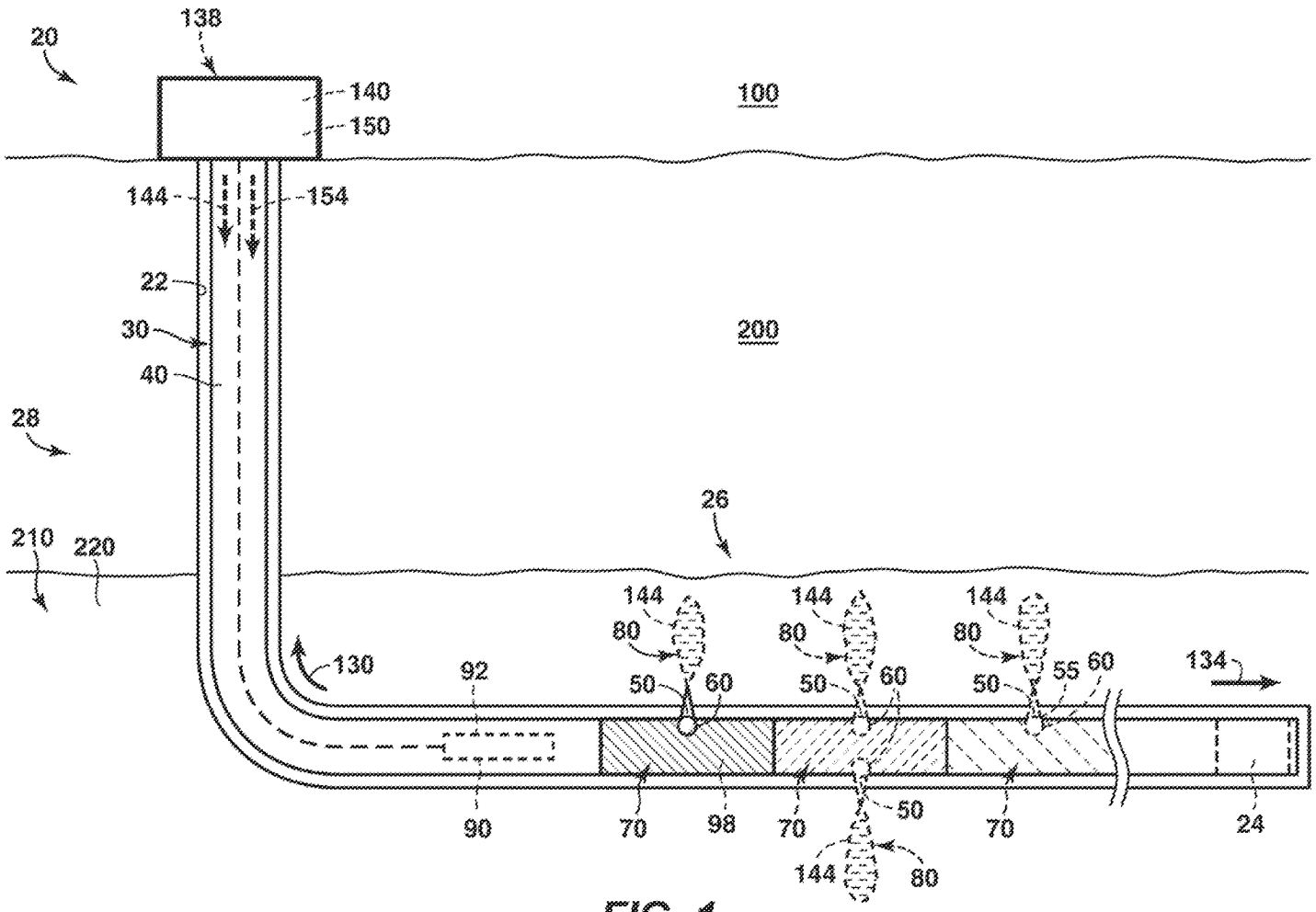
FIG. 1 is a schematic representation of illustrative, non-exclusive examples of a hydrocarbon well that may be utilized with and/or include the systems and methods according to the present disclosure.

FIGS. 1-8 provide illustrative, non-exclusive examples of hydrocarbon wells 20 according to the present disclosure and/or of stimulation operations according to the present disclosure that may be performed within hydrocarbon wells 20 and/or that may utilize fluid plugs 70 according to the present disclosure. Elements that serve a similar, or at least substantially similar, purpose are labeled with like numbers in each of FIGS. 1-8, and these elements may not be discussed in detail herein with reference to each of FIGS. 1-8. Similarly, all elements may not be labeled in each of FIGS. 1-8, but reference numerals associated therewith may be utilized herein for consistency. Elements, components, and/or features that are discussed herein with reference to one or more of FIGS. 1-8 may be included in and/or utilized with any of FIGS. 1-8 without departing from the scope of the present disclosure.

In general, elements that are likely to be included in a given (i.e., a particular) embodiment are illustrated in solid lines, while elements that are optional to a given embodiment are illustrated in dashed lines. However, elements that are shown in solid lines are not essential to all embodiments, and an element shown in solid lines may be omitted from a particular embodiment without departing from the scope of the present disclosure.

FIG. 1 is a schematic representation of illustrative, non-exclusive examples of a hydrocarbon well 20 that may be utilized with and/or include the systems and methods according to the present disclosure. Hydrocarbon well 20, which also may be referred to herein as a well 20, includes a wellbore 22. Wellbore 22 extends between a surface region 100 and a subsurface region 200 that includes a subterranean formation 210. A production casing 30 extends within wellbore 22 and defines a casing conduit 40. Hydrocarbon well 20 may include at least one horizontal portion 26 and/or at least one vertical portion 28. In some embodiments, the hydrocarbon well may include a vertical portion and a horizontal portion that is longer, and optionally much longer, than the vertical portion.

Well 20 may include and/or utilize a stimulation assembly 138. Simulation assembly 138 may include and/or be any suitable structure that may be utilized to stimulate subterranean formation 210 to increase, or enhance, production of a reservoir fluid 220, which also may be referred to herein as a hydrocarbon 220, therefrom. As an illustrative, non-exclusive example, stimulation assembly 138 may include a perforation device 90, a stimulating fluid supply system 140, and/or a sealing fluid supply system 150. Initially, the stimulating may include fluidly isolating casing conduit 40 from subterranean formation 210 (such as by locating an isolation plug 24 within the casing conduit). Subsequently, one or more perforations 50 may be created, opened, and/or accessed within production casing 30, such as by perforation device 90. Additionally or alternatively, the one or more perforations 50 already may be present within production casing 30, such as by being formed within the production casing prior to the production casing being located within wellbore 22, by being opened, accessed, and/or made available for fluid flow subsequent to the production casing being located within wellbore 22, and/or by being previously formed by, or by another, perforation device 90. These perforations may provide fluid communication between casing conduit 40 and subterranean formation 210, such as through a wall of production casing 30.

Then, a stimulating fluid 144 may be flowed from stimulating fluid supply system 140 into casing conduit 40, through perforations 50, and into subterranean formation 210 to stimulate one or more regions 80 thereof. This may include acid treating region 80, creating one or more fractures within region 80, and/or otherwise increasing a fluid permeability of region 80. The stimulation also may include locating one or more sealing devices 60 proximate, on, and/or near perforations 50 to at least partially seal the perforations and subsequently forming one or more fluid plugs 70 within the casing conduit to temporarily retain sealing devices 60 proximal to and/or on perforations 50.

Fluid plug 70 may be located and/or formed such that the fluid plug is in contact, physical contact, and/or mechanical contact with sealing device 60, thereby permitting the fluid plug to retain the sealing device on perforation 50. As an illustrative, non-exclusive example, fluid plug 70 may be in contact with, may coat, may cover, may encompass, and/or may encapsulate sealing device 60.

In general, and without fluid plug 70, a respective sealing device 60 may be retained in contact with a respective perforation 50 by a pressure differential between casing conduit 40 and subterranean formation 210, with the pressure in casing conduit 40 being greater than the pressure within subterranean formation 210. However, a seal between sealing device 60 and perforation 50 may be imperfect and/or may permit a leakage flow of fluid therepast. In addition, a magnitude of the pressure differential between casing conduit 40 and subterranean formation 210 may fluctuate and/or may, at times, be insufficient to retain sealing device 60 on perforation 50. In addition, and once sealing device 60 is removed from contact with perforation 50, the sealing device may not return to and/or re-seal the perforation. Thus, sealing device 60, in and of itself, may not completely fluidly isolate casing conduit 40 from subterranean formation 210 and/or may not provide a desired level of fluid isolation between casing conduit 40 and subterranean formation 210. Moreover, and without fluid plug 70, when a pressure in the subterranean formation proximate the sealing device exceeds and/or is less than a threshold pressure of the pressure within the casing conduit proximate the sealing device, the sealing device may not seal (or sufficiently seal) the perforation and/or may not be retained in contact with (or even adjacent) the perforation.

With this in mind, fluid plug 70 may be utilized to decrease a potential for the leakage flow past sealing device 60 when the sealing device forms an imperfect seal with perforation 50. As an illustrative, non-exclusive example, fluid plug 70 may, in and of itself, form a barrier to fluid flow from a portion of casing conduit 40 that is uphole from the fluid plug (or located in an uphole direction 130 from the fluid plug) to a portion of casing conduit 40 that is downhole from the fluid plug (or located in a downhole direction 134 from the fluid plug). As another illustrative, non-exclusive example, fluid plug 70 may restrict, block, and/or occlude a leakage pathway past sealing device 60, thereby decreasing and/or eliminating the leakage flow of fluid therepast. As yet another illustrative, non-exclusive example, fluid plug 70 may retain sealing device 60 proximal to, on, and/or near perforation 50, such as even if the pressure differential between the casing conduit and the subterranean formation otherwise would urge the sealing device away from the perforation. This may permit sealing device 60 to re-seal and/or to repeatedly seal perforation 50, when needed, to restrict fluid flow therethrough.

It is within the scope of the present disclosure that hydrocarbon well 20 may include, temporarily include, or at least temporarily include any suitable number of fluid plugs 70 and/or that fluid plugs 70 may be present in and/or fill any suitable portion of casing conduit 40. As an illustrative, non-exclusive example, casing conduit 40 may include a single fluid plug 70. As another illustrative, non-exclusive example, casing conduit 40 may include a plurality of fluid plugs 70 that may be separate and/or distinct from one another and/or that may be adjoining, touching, and/or abutting one another. As illustrative, non-exclusive examples, casing conduit 40 may include at least 2, at least 3, at least 4, at least 5, at least 6, at least 7, at least 8, at least 9, or at least 10 fluid plugs 70.

When casing conduit 40 includes a plurality of fluid plugs 70, it is within the scope of the present disclosure that at least one of the fluid plugs may be formed within casing conduit 40 at a different time than at least one other of the fluid plugs. In addition, and as discussed in more detail herein, fluid plugs 70 may be selected, formulated, and/or synthesized to remain in casing conduit 40 for, or for at least, a threshold sealing time and to subsequently and/or automatically break, break down, decay, and/or decrease in viscosity to permit and/or otherwise cause and/or promote removal of the fluid plugs from the casing conduit. Thus, and when casing conduit 40 includes a plurality of fluid plugs that were formed therein at different times, a remaining sealing time for a respective sealing plug may be less than a remaining sealing time for another sealing plug (such as a sealing plug that is located uphole from the respective sealing plug).

Fluid plug 70 may fill, at least substantially fill, and/or entirely fill at least a portion, or fraction, of a length of casing conduit 40. Thus, and as discussed, fluid plug 70 may resist and/or prevent fluid flow therepast and/or may prevent fluid flow between a portion of casing conduit 40 that is uphole from the fluid plug and a portion of casing conduit 40 that is downhole from the fluid plug.

As illustrative, non-exclusive examples, a given fluid plug 70 may fill at least 0.1%, at least 0.2%, at least 0.3%, at least 0.4%, at least 0.5%, at least 0.6%, at least 0.7%, at least 0.8%, at least 0.9%, at least 1%, at least 1.25%, at least 1.5%, at least 1.75%, at least 2%, at least 2.25%, at least 2.5%, at least 2.75%, or at least 3% of the length of casing conduit 40. Additionally or alternatively, the given fluid plug 70 also may fill less than 5%, less than 3.75%, less than 3.5%, less than 3.25%, less than 3%, less than 2.75%, less than 2.5%, less than 2.25%, less than 2%, less than 1.75%, less than 1.5%, less than 1.25%, or less than 1% of the length of casing conduit 40.

As additional illustrative, non-exclusive examples, a length of fluid plug 70, as measured along a longitudinal axis thereof, may be at least 20 m, at least 30 m, at least 40 m, at least 50 m, at least 60 m, at least 70 m, at least 80 m, at least 90 m, at least 100 m, at least 110 m, at least 120 m, or at least 130 m. Additionally or alternatively, the length of fluid plug 70 may be less than 250 m, less than 240 m, less than 230 m, less than 220 m, less than 210 m, less than 200 m, less than 190 m, less than 180 m, less than 170 m, less than 160 m, less than 150 m, less than 100 m, or less than 50 m.

Additionally or alternatively, fluid plug 70 (and/or a material composition thereof) also may be selected, configured, formulated, and/or synthesized to resist and/or prevent the fluid flow therepast when a pressure differential across the fluid plug is less than a threshold pressure differential. As illustrative, non-exclusive examples, the threshold pressure differential may be at least 5 Megapascals (MPa), at least 10 MPa, at least 15 MPa, at least 20 MPa, at least 25 MPa, at least 30 MPa, at least 35 MPa, at least 40 MPa, at least 45 MPa, or at least 50 MPa.

Fluid plugs 70 may include and/or be defined by any suitable material, which may be selected, configured, formulated, and/or synthesized to temporarily retain sealing device 60 on and/or in contact with perforation 50, and fluid plugs 70 may be located within casing conduit 40 in any suitable manner. As an illustrative, non-exclusive example, hydrocarbon well 20 and/or stimulation assembly 138 may include sealing fluid supply system 150, which may be configured to provide a sealing fluid 154 to casing conduit 40. This may include pumping the sealing fluid into casing conduit 40, such as from surface region 100. Additionally or alternatively, this may include releasing the sealing fluid from within the casing conduit, such as via a dump bailer 92 or other downhole delivery device or vehicle that may be associated with and/or operatively attached to perforation device 90 and/or which may be flowed, pumped, conveyed, installed, supported or otherwise positioned within the casing conduit and thereafter actuated to release the sealing fluid into the casing conduit to provide the fluid plug(s) provided for herein.

Sealing fluid 154 may be selected, configured, formulated, and/or synthesized to have a sufficiently low viscosity to permit the sealing fluid to flow within casing conduit 40 in response to a pressure differential. As illustrative, non-exclusive examples, sealing fluid 154 may be selected to have a viscosity of less than 1,000 centipoise (cP), less than 500 cP, less than 250 cP, less than 100 cP, less than 50 cP, less than 40 cP, less than 30 cP, less than 20 cP, less than 10 cP, less than 8 cP, less than 6 cP, less than 4 cP, less than 2 cP, or less than 1 cP at the temperatures and/or pressures that are present within casing conduit 40.

In addition, sealing fluid 154 also may be selected, configured, formulated, and/or synthesized to form and/or become fluid plug 70 subsequent to flowing to a given, desired, and/or target region of casing conduit 40. As an illustrative, non-exclusive example, sealing fluid 154 may include and/or be a shear thickening fluid that may flow within casing conduit 40 under the (relatively) lower shear conditions that may be present therein but that may resist flowing under the (relatively) higher shear conditions that may be present near and/or within the leakage flow past sealing device 60.

As another illustrative, non-exclusive example, sealing fluid 154 may be selected, configured, formulated, and/or synthesized such that a viscosity thereof increases to form fluid plug 70, thereby providing increased resistance to and/or preventing fluid flow therethrough and/or therepast. As illustrative, non-exclusive examples, the viscosity of fluid plug 70 may be at least 2, at least 4, at least 6, at least 8, at least 10, at least 15, at least 20, at least 40, at least 50, at least 75, at least 100, at least 250, at least 500, at least 750, at least 1,000, at least 2,500, at least 5,000, at least 7,500, at least 10,000, at least 25,000, at least 50,000, at least 75,000, at least 100,000, at least 250,000, at least 500,000, at least 750,000, or at least 1,000,000 times greater than the viscosity of sealing fluid 154 prior to formation of fluid plug 70. As an illustrative, non-exclusive example, this viscosity increase may be responsive to contact between sealing fluid 154 and an initiation compound, may be responsive to a temperature change of the sealing fluid, and/or may be responsive to the sealing fluid being within casing conduit 40 for at least a threshold time period. As additional illustrative, non-exclusive examples, sealing fluid 154 may include and/or be a crosslinking solution, such as a crosslinking polymer solution, a crosslinking gel solution, and/or a borate gel solution, that may be selected to crosslink within the desired region of the casing conduit.

When sealing fluid 154 includes a borate gel solution, the borate gel solution may include a borate solute dissolved in a solvent, such as (but not limited to) water, and it is within the scope of the present disclosure that the borate solute may comprise any suitable portion, or fraction, of the borate gel solution. As illustrative, non-exclusive examples, the borate solute may comprise at least 0.05 weight % (wt %), at least 0.1 wt %, at least 0.15 wt %, at least 0.2 wt %, at least 0.25 wt %, at least 0.3 wt %, at least 0.35 wt %, at least 0.4 wt %, at least 0.45 wt %, at least 0.5 wt %, at least 0.55 wt %, at least 0.6 wt %, at least 0.65 wt %, or at least 0.7 wt % of the borate gel solution. As additional illustrative, non-exclusive examples, the borate solute may comprise less than 1 wt %, less than 0.9 wt %, less than 0.8 wt %, less than 0.7 wt %, less than 0.65 wt %, less than 0.6 wt %, less than 0.55 wt %, less than 0.5 wt %, less than 0.45 wt %, less than 0.4 wt %, less than 0.35 wt %, less than 0.3 wt %, less than 0.25 wt %, or less than 0.2 wt % of the borate gel solution.

It is within the scope of the present disclosure that sealing fluid 154, and/or fluid plug 70 that is formed therefrom, further may include and/or contain one or more supplemental materials 98 that may be selected and/or configured to improve a pressure-resistance of fluid plug 70, to decrease a potential for (and/or a magnitude of) fluid flow past fluid plug 70, and/or to decrease a potential for (and/or a magnitude of) the leakage flow past sealing device 60. As illustrative, non-exclusive examples, the supplemental material may include and/or be a supplemental sealing device, a supplemental ball sealer, a supplemental sealing material, and/or a breaking compound that is selected to break and/or degrade the fluid plug. Illustrative, non-exclusive examples of supplemental sealing materials include cellophane flakes, organic media (such as cotton seed hulls and/or walnut shells), sawdust, benzoic acid flakes, shaved rock salt, and/or sieve-sized sand.

Sealing device 60 may include any suitable structure that may be selected and/or configured to seal, or at least partially seal, perforations 50. As illustrative, non-exclusive examples, sealing device 60 may include and/or be a ball, a sphere, a ball sealer, and/or an elastomeric ball. As another illustrative, non-exclusive example, sealing device 60 may be sized to seal perforation 50, such as to permit formation of a fluid seal between the sealing device and the perforation (or a sealing surface 55 thereof) while preventing the sealing device from flowing through the perforation and into subterranean formation 210.

Stimulating fluid 144 may include any suitable fluid, suspension, and/or slurry that may be selected, formulated, synthesized, and/or configured to create fractures within regions 80 of subterranean formation 210 and/or to otherwise stimulate the subterranean formation when supplied thereto and/or when pressurized therewithin. As illustrative, non-exclusive examples, stimulating fluid 144 may include and/or be a proppant, water, an acid, a surfactant, and/or a foam. As another illustrative, non-exclusive example, stimulating fluid 144 may include and/or be a fracturing gel solution that is selected, formulated, synthesized, and/or configured to gel within subterranean formation 210 for less than the threshold sealing time of sealing fluid 154 and/or of fluid plug 70. As illustrative, non-exclusive examples, the fracturing gel solution may be selected to gel for less than 4 hours, less than 3 hours, less than 2.5 hours, less than 2 hours, less than 1.5 hours, or less than 1 hour. Additionally or alternatively, the fracturing gel solution also may be selected to gel for at least 30 minutes, at least 1 hour, at least 2 hours, or at least 3 hours.

FIGS. 2-8 provide schematic representations of illustrative, non-exclusive examples of a stimulation operation that may be performed within a portion of a hydrocarbon well 20 and that may include and/or utilize the systems and methods according to the present disclosure. In FIGS. 2-8, hydrocarbon well 20 includes a wellbore 22 that extends within a subterranean formation 210. A production casing 30 extends within wellbore 22 and defines a casing conduit 40 therein. As illustrated in FIGS. 2-5, a perforation device 90 may be located within casing conduit 40 and may be utilized to create one or more perforations 50 within production casing 30.

Figure 2:
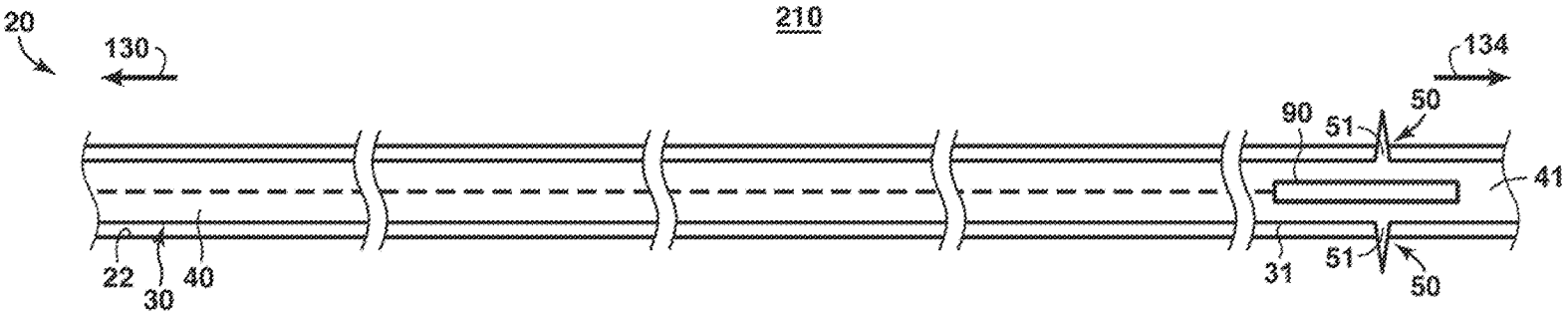
FIG. 2 is a schematic representation of an illustrative, non-exclusive example of a stimulation operation that may include and/or utilize the systems and methods according to the present disclosure.

In FIG. 2, perforation device 90 is located within a first region 41 of casing conduit 40 and has created a plurality of first perforations 51 within production casing 30 to define a first perforated section 31 of the production casing; however, it is within the scope of the present disclosure that production casing 30 may include other perforated sections that may be formed prior to formation of perforated section 31 and/or that one or more perforated sections of the production casing may be defined therein prior to the production casing being located within the wellbore. Subsequently, and as illustrated in FIG. 3, a stimulating fluid 144 may flow from casing conduit 40 to a first portion 211 of subterranean formation 210 via first perforations 51 to stimulate region 80 and/or to create one or more fractures therein, which also may be referred to herein as first fractures that may be present within a first region 81.

It is within the scope of the present disclosure that stimulating fluid 144 may be provided to casing conduit 40 in any suitable manner and/or in any suitable sequence relative to the formation of first perforations 51. As an illustrative, non-exclusive example, supply of stimulating fluid 144 to casing conduit 40 may be initiated prior to creation of first perforations 51. As such, and if casing conduit 40 is fluidly isolated from subterranean formation 210 prior to creation of first perforations 51, supply of the stimulating fluid may increase the pressure within the casing conduit. Thus, flow of the stimulating fluid through first perforations 51 may be initiated responsive, directly responsive, and/or as a result of creation of first perforations 51 and/or may occur immediately upon creation of first perforations 51. Additionally or alternatively, it is also within the scope of the present disclosure that supply of stimulating fluid 144 to casing conduit 40 may be initiated subsequent to creation of first perforations 51 and/or responsive to creation of first perforations 51.

Figure 3:
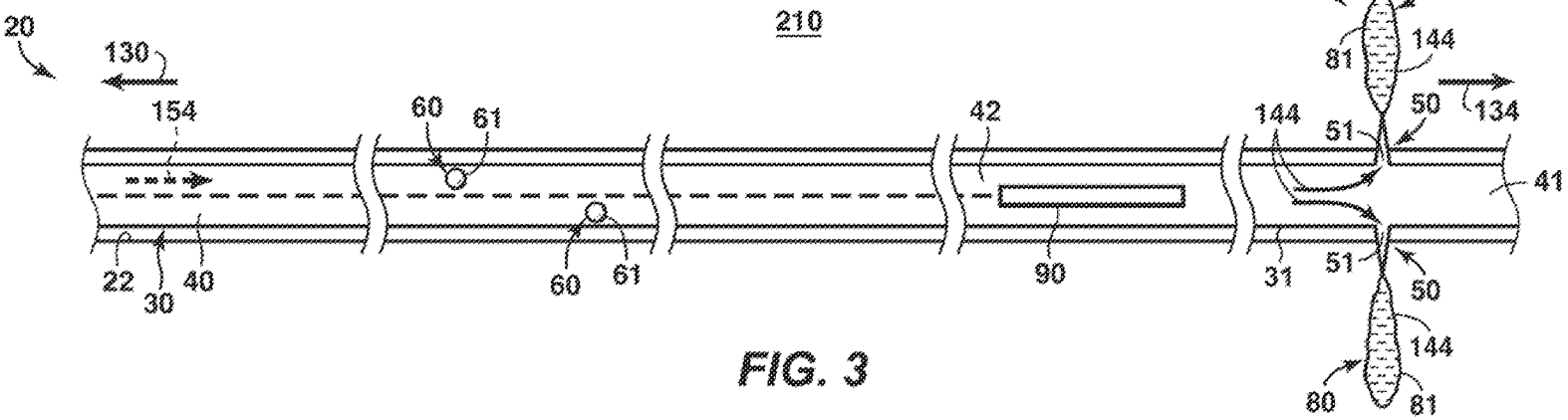
FIG. 3 is another schematic representation of an illustrative, non-exclusive example of a stimulation operation that may include and/or utilize the systems and methods according to the present disclosure.

As also illustrated in FIG. 3, the stimulation operation further may include moving perforation device 90 in uphole direction 130 such that the perforation device is located within a second region 42 of casing conduit 40 that is uphole from first region 41. In addition, a plurality of sealing devices 60, which also may be referred to herein as a plurality of first sealing devices 61, and a sealing fluid 154 also may be provided to casing conduit 40. The presence of first perforations 51 may permit first sealing devices 61 and sealing fluid 154 to flow within casing conduit 40 in downhole direction 134 and to thereby flow toward and/or into first region 41.

Figure 4:
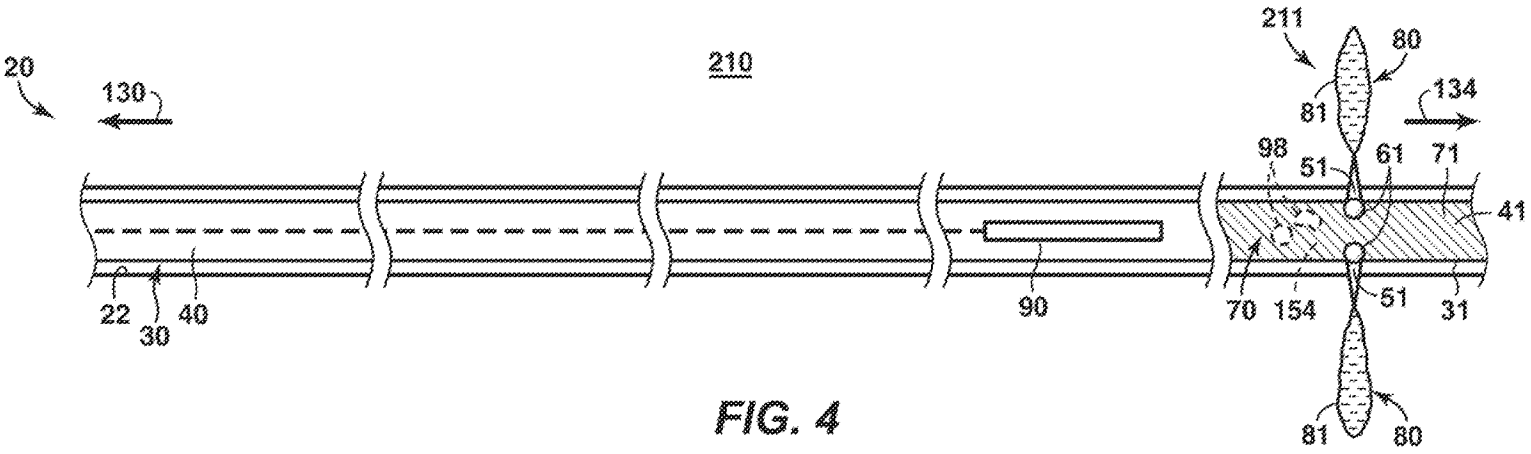
FIG. 4 is another schematic representation of illustrative, non-exclusive examples of a stimulation operation that may include and/or utilize the systems and methods according to the present disclosure.

Subsequently, and as illustrated in FIG. 4, first sealing devices 61 may be located on first perforations 51 and sealing fluid 154 may form a fluid plug 70, which also may be referred to herein as a first fluid plug 71, within first region 41 of casing conduit 40. As discussed, first fluid plug 71 may retain first sealing devices 61 on first perforations 51, thereby decreasing a potential for fluid flow therepast. Additionally or alternatively, first fluid plug 71 also may fluidly isolate a portion of casing conduit 40 that is uphole from first region 41 from a portion of the casing conduit that is downhole from first region 41.

As also illustrated in FIG. 4 and discussed herein, one or more supplemental materials 98 may be located within first fluid plug 71 (such as by being provided to casing conduit 40 with sealing fluid 154). These supplemental materials may further decrease a potential for fluid flow past first sealing devices 61 and/or may replace a respective first sealing device 61 should the respective first sealing device be displaced from a respective first perforation 51 that is associated therewith.

Figure 5:
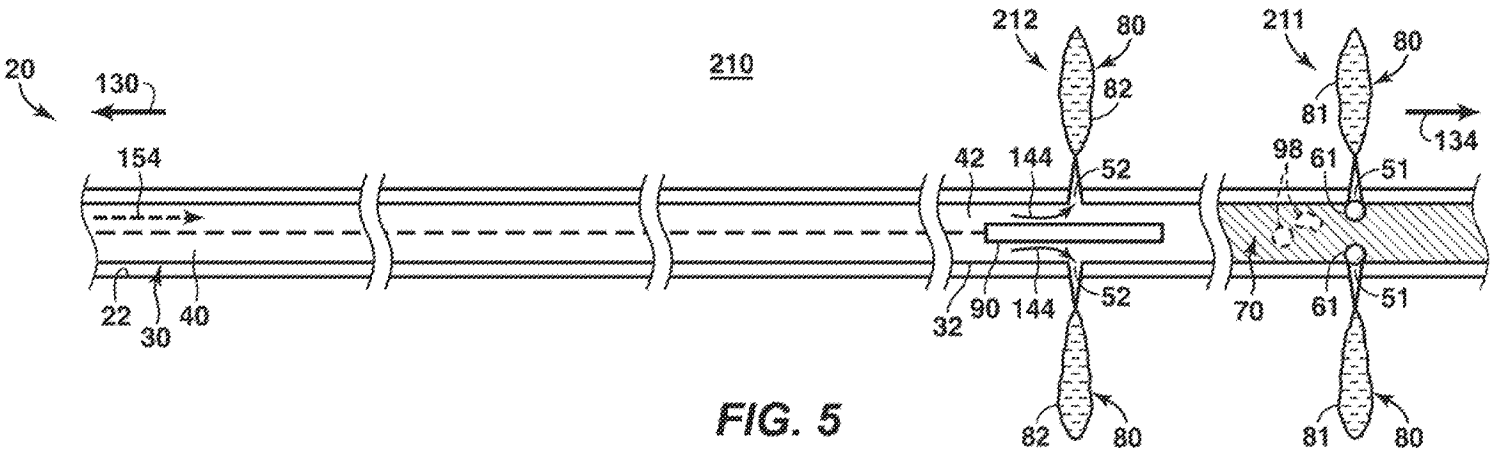
FIG. 5 is another schematic representation of illustrative, non-exclusive examples of a stimulation operation that may include and/or utilize the systems and methods according to the present disclosure.

Subsequently, and as illustrated in FIG. 5, perforation device 90 may be utilized to form a plurality of second perforations 52 within casing conduit 40 to define a second perforated section 32 of the production casing. In addition, and as also illustrated in FIG. 5, stimulating fluid 144 may flow from casing conduit 40 to a second portion 212 of subterranean formation 210 via second perforations 52 to stimulate another region 80 of the subterranean formation, which also may be referred to herein as a second region 82, and/or to generate a plurality of second fractures therein. The plurality of second perforations 52 then may be sealed by a plurality of second sealing devices 62, and a second fluid plug 72 may be formed within second region 42 of the casing conduit, as illustrated in FIG. 6.

Figure 6:
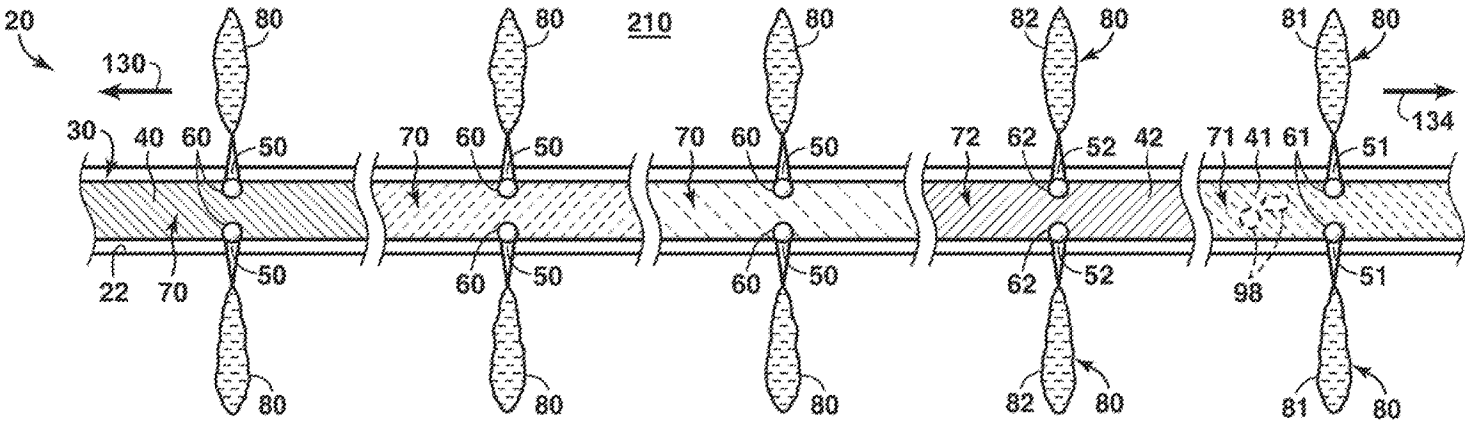
FIG. 6 is another schematic representation of illustrative, non-exclusive examples of a stimulation operation that may include and/or utilize the systems and methods according to the present disclosure.

As also illustrated in FIG. 6 and discussed herein, this process may be repeated any suitable number of times to stimulate any suitable number of regions 80 and/or to create any suitable number of fractures within any suitable number of portions of subterranean formation 210. In addition, fluid plugs 70 according to the present disclosure may be selected to have, or to exhibit, a threshold sealing time. Thus, and as discussed herein, when casing conduit 40 includes a plurality of fluid plugs 70 that were sequentially and/or serially formed therein, a remaining sealing time of a given fluid plug (such as first fluid plug 71) may be less than a remaining sealing time of another fluid plug (such as second fluid plug 72) that is uphole from the given fluid plug. This is illustrated in FIG. 6 by the progressively higher fill pattern density of fluid plugs 70 relative to other fluid plugs 70 that are downhole therefrom.

Figure 7:
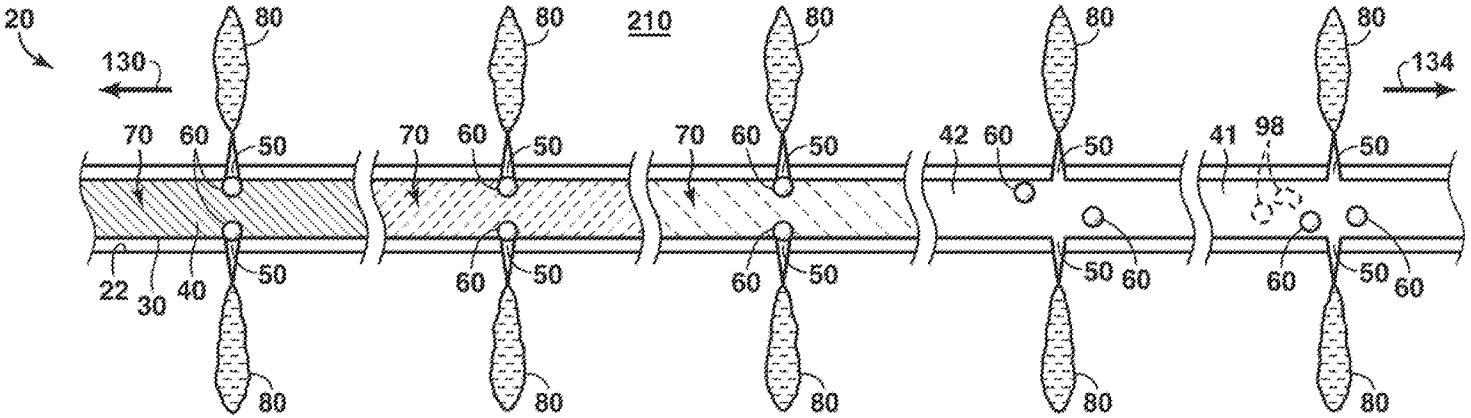
FIG. 7 is another schematic representation of illustrative, non-exclusive examples of a stimulation operation that may include and/or utilize the systems and methods according to the present disclosure.
Figure 8:
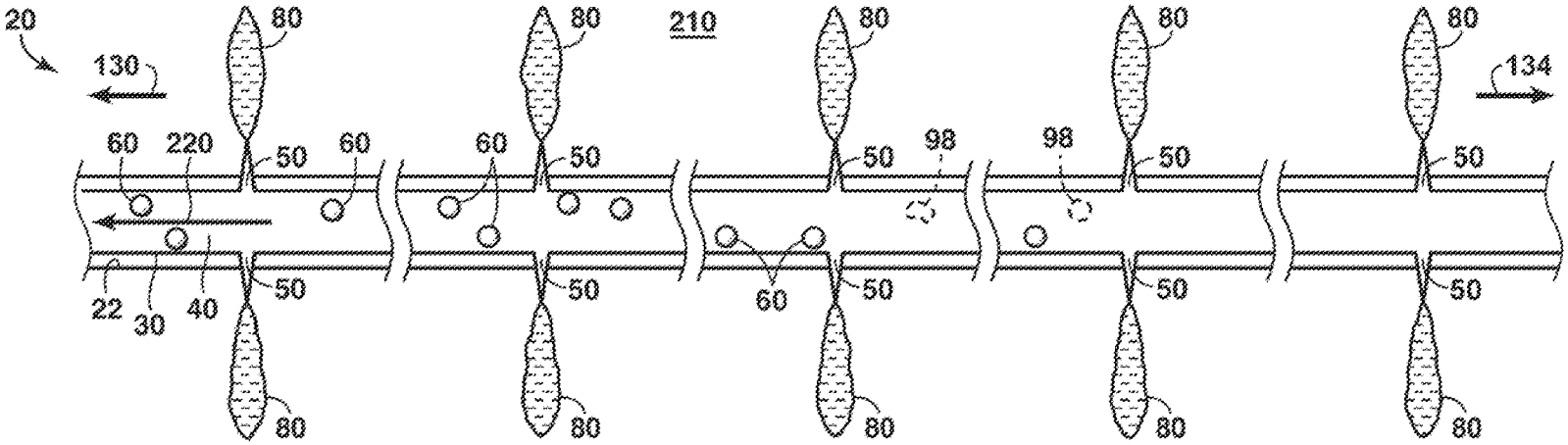
FIG. 8 is another schematic representation of illustrative, non-exclusive examples of a stimulation operation that may include and/or utilize the systems and methods according to the present disclosure.

Thus, fluid plugs 70 will begin to degrade, disintegrate, and/or break after the threshold sealing time, with fluid plugs that were formed first degrading prior to fluid plugs that were formed later in time (and that are thus located relatively uphole therefrom). This is illustrated in FIG. 7, where the fluid plugs that were associated with first region 41 and second region 42 of casing conduit 40 have completely degraded. Eventually, and as illustrated in FIG. 8, all fluid plugs that are present within casing conduit 40 will degrade. This may permit production of reservoir fluid 220 from subterranean formation 210 and/or removal of sealing devices 60 and/or supplemental materials 98 from casing conduit 40 by flowing the sealing devices and/or the supplemental materials from the casing conduit with, or within, reservoir fluid 220.

Figure 9:
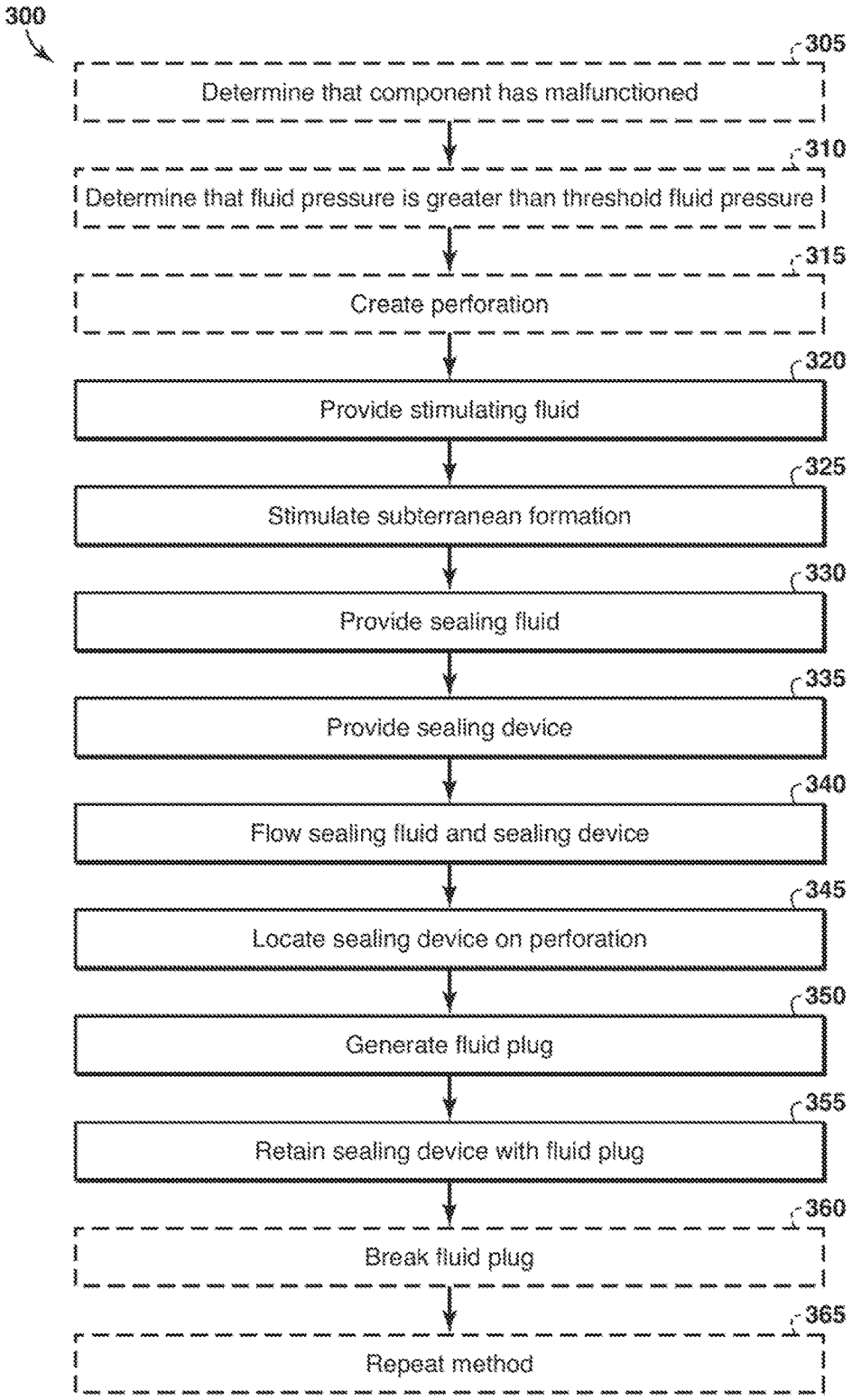
FIG. 9 is a flowchart depicting methods according to the present disclosure of stimulating a subterranean formation.

FIG. 9 is a flowchart depicting methods 300 according to the present disclosure of stimulating a subterranean formation. Methods 300 optionally may include determining, at 305, that a component of a stimulation assembly has failed, determining, at 310, that a fluid pressure within a casing conduit that is defined by a production casing is greater than a threshold fluid pressure, and/or creating, at 315, a perforation in a perforated section of production casing. Methods 300 include providing a stimulating fluid to a casing conduit that is defined by the production casing at 320 and stimulating a portion of a subterranean formation in which the production casing extends at 325. Methods 300 further include providing a sealing fluid to the casing conduit at 330 and providing a sealing device to the casing conduit at 335. Methods 300 also include flowing the sealing fluid and the sealing device to the perforated section of the production casing at 340, locating the sealing device on the perforation at 345, generating a fluid plug within the perforated section of the production casing at 350, and retaining the sealing device with the fluid plug at 355. Methods 300 further may include breaking the fluid plug at 360 and/or repeating at least a portion of the methods at 365.

Determining, at 305, that the component of the stimulation assembly has failed may include determining that any suitable component of the stimulation assembly has failed to operate and/or that the component is not operating in an expected manner. As illustrative, non-exclusive examples, the detecting at 305 may include detecting a failure of a pump that is configured to provide the stimulating fluid to the casing conduit, detecting a failure of a perforation device that is configured to create one or more perforations in the production casing, detecting a failure of one or more sealing devices to seal one or more perforations within the production casing, detecting a pressure within the casing conduit that is below a threshold pressure, detecting a failure in one or more valves and/or other flow control devices that may be configured to control a flow rate of the stimulating fluid to the casing conduit, detecting a failure and/or breakage of a pipe and/or of casing that is in communication with and/or is the production casing, and/or detecting a failure of an isolation plug that is configured to fluidly isolate an uphole portion of the casing conduit from a downhole portion of the casing conduit and/or from the subterranean formation. Such a failure may be detrimental to operation of the stimulation assembly and/or may permit one or more sealing devices that may be associated therewith to be displaced from one or more respective perforations.

When methods 300 include the determining at 305, it is within the scope of the present disclosure that methods 300 further may include initiating and/or performing a remainder of methods 300 responsive to and/or based upon the determining at 305. As an illustrative, non-exclusive example, this may include performing, or initiating, at least the providing at 330 responsive to the determining at 305.

It is within the scope of the present disclosure that the providing at 320 may include providing the stimulating fluid to the casing conduit prior to the creating at 315 and that the providing at 320 may include pressurizing the casing conduit with the stimulating fluid. This may include increasing a pressure, or a fluid pressure, within the casing conduit with the stimulating fluid. When the providing at 320 is performed prior to the creating at 315, methods 300 further may include determining, at 310, that the fluid pressure within the casing conduit is greater than a threshold fluid pressure, such as a fracture pressure of the subterranean formation, and the creating at 315 may be initiated responsive to the determining at 310 (or responsive to the fluid pressure being greater than the threshold fluid pressure).

Under these conditions, the providing at 320 and/or the providing at 330 may be performed continuously, or at least substantially continuously, during at least a threshold fraction of a time period during which methods 300 are performed. Illustrative, non-exclusive examples of the threshold fraction of the time period include at least 75%, at least 80%, at least 85%, at least 90%, at least 95%, at least 97.5%, at least 99%, or 100% of the time period during which methods 300 are performed. Additionally or alternatively, and since a perforation device that is utilized during the creating at 315 may remain within the casing conduit during the providing at 330 and during the providing at 335, the flowing at 340 may include flowing the sealing device through an annular space that is defined between the production casing and the perforation device.

Creating the perforation in the perforated section of the production casing at 315 may include creating the perforation to provide fluid communication between the subterranean formation and the casing conduit. This may include creating the perforation within the perforated section of the production casing and/or creating any suitable perforation within the production casing to create and/or to define the perforated section of the production casing.

It is within the scope of the present disclosure that the perforation may be created in any suitable manner. As an illustrative, non-exclusive example, methods 300 further may include locating a perforation device, such as a perforation gun, within the production casing and/or within the perforated section of the production casing prior to and/or as a part of the creating at 315. As another illustrative, non-exclusive example, the creating at 315 may include perforating the production casing with the perforation device, such as by discharging a perforation charge of the perforation gun.

Providing the stimulating fluid to the casing conduit at 320 may include providing any suitable stimulating fluid, illustrative, non-exclusive examples of which are disclosed herein, to the casing conduit in any suitable manner. As illustrative, non-exclusive examples, the providing at 320 may include providing the stimulating fluid to the casing conduit with a stimulating fluid supply system, pumping the stimulating fluid into the casing conduit, providing the stimulating fluid from a surface region into the casing conduit, and/or pressurizing the casing conduit with the stimulating fluid.

Stimulating the portion of the subterranean formation at 325 may include stimulating any suitable portion of the subterranean formation as a result of, and/or responsive to, the providing at 320. As an illustrative, non-exclusive example, the stimulating at 325 may include flowing a portion of the stimulating fluid through the perforation and into the portion of the subterranean formation. As another illustrative, non-exclusive example, the stimulating at 325 may include pressurizing the portion of the subterranean formation, such as to a pressure that is greater than the fracture pressure of the subterranean formation. As yet another illustrative, non-exclusive example, the stimulating at 325 may include fracturing the portion of the subterranean formation. As another illustrative, non-exclusive example, and when methods 300 include the determining at 310 and the providing at 320 is performed prior to the creating at 315, the stimulating at 325 may be responsive to, directly responsive to, and/or a result of the perforating at 315.

Providing the sealing fluid to the casing conduit at 330 may include providing any suitable sealing fluid to the casing conduit. It is within the scope of the present disclosure that the sealing fluid may have a different composition, or chemical composition, than a composition of the stimulating fluid. As such, methods 300 may include providing a sealing fluid that is different from the stimulating fluid, may include transitioning from the providing at 320 to the providing at 330, may include ceasing the providing at 320 prior to initiating the providing at 330, may include ceasing the providing at 320 concurrently with initiating the providing at 330, may include ceasing the providing at 320 subsequent to initiating the providing at 330, may include initiating the providing at 330 subsequent to the providing at 320, and/or may include initiating the providing at 330 subsequent to the stimulating at 325.

The sealing fluid may be provided to the casing conduit in any suitable manner. As an illustrative, non-exclusive example, the providing at 330 may include providing the sealing fluid from the surface region to the casing conduit, providing the sealing fluid with a sealing fluid supply system, pumping the sealing fluid into the casing conduit, releasing the sealing fluid from within the casing conduit, and/or releasing the sealing fluid from a dump bailer or other delivery device or vehicle that is present within the casing conduit and/or that is associated with and/or operatively attached to the perforation device.

Providing the sealing device to the casing conduit at 335 may include providing any suitable sealing device, which is selected and/or configured to at least partially seal the perforation, to the casing conduit. As illustrative, non-exclusive examples, the sealing device may include and/or be an elastomeric sealing device, a polymeric sealing device, a resilient sealing device, and/or a dissolving sealing device. As another illustrative, non-exclusive example, the sealing device may define a spherical, or at least substantially spherical, shape. As yet another illustrative, non-exclusive example, the sealing device may include and/or be a ball sealer.

The providing at 335 may be performed in any suitable manner. As an illustrative, non-exclusive example, the providing at 335 may include providing the sealing device from the surface region and into the casing conduit. As another illustrative, non-exclusive example, the providing at 335 may be performed concurrent with, or at least partially concurrently with, the providing at 330. As yet another illustrative, non-exclusive example, the providing at 335 may be performed subsequent to the providing at 320 and/or subsequent to the stimulating at 325.

It is within the scope of the present disclosure that methods 300 may include coordinating and/or timing the providing at 330 with the providing at 335. As an illustrative, non-exclusive example, the providing at 330 may include providing a volume of the sealing fluid to the casing conduit and methods 300 may include timing the providing at 330 with the providing at 335 such that less than an upper threshold fraction of the sealing fluid flows through the perforation. This may include timing the providing at 330, the providing at 335, and/or the generating at 350 to limit flow of the sealing fluid through the perforation and into the subterranean formation. Illustrative, non-exclusive examples of the upper threshold fraction of the sealing fluid include a minority fraction of the sealing fluid and/or threshold fractions of less than 25%, less than 20%, less 15%, less than 10%, or less than 5% of the volume of the sealing fluid.

Additionally or alternatively, methods 300 also may include timing the providing at 330 with the providing at 335 such that at least a lower threshold fraction, but not all, of the sealing fluid flows through the perforation. This may increase a potential for the generating at 350 to generate the fluid plug within the perforated section of the production casing and/or to generate the fluid plug such that the fluid plug is in contact with, supports, and/or retains the sealing device during the retaining at 355. Illustrative, non-exclusive examples of the lower threshold fraction of the sealing fluid include threshold fractions of at least 0.1%, at least 0.5%, at least 1%, at least 2%, at least 3%, at least 4%, or at least 5% of the volume of the sealing fluid.

Flowing the sealing fluid and the sealing device to the perforated section of the production casing at 340 may include flowing the sealing fluid and the sealing device in any suitable manner. As an illustrative, non-exclusive example, the flowing at 340 may include flowing the sealing device at least partially concurrently with flowing the sealing fluid. As another illustrative, non-exclusive example, the flowing at 340 may include flowing the sealing device within and/or by the sealing fluid (or the volume of the sealing fluid). As yet another illustrative, non-exclusive example, the flowing at 340 may include flowing the sealing fluid and the sealing device from the surface region to the perforated section of the production casing.

As discussed in more detail herein, it is within the scope of the present disclosure that methods 300 may include generating a plurality of discrete and/or independent fluid plugs within the casing conduit. As such, a given fluid plug may extend within a given perforated section of the production casing but may not extend within, or fill, an entire length, or volume, of the casing conduit that extends between the perforated section of the production casing and the surface region. As such, the flowing at 340 further may include providing a carrier fluid, such as the stimulating fluid, to the casing conduit to push and/or otherwise convey the volume of the sealing fluid and the sealing device to the perforated section of the production casing.

Locating the sealing device on the perforation at 345 may include at least partially sealing the perforation with the sealing device. As illustrative, non-exclusive examples, the locating at 345 may include decreasing an area for fluid flow through the perforation, occluding the perforation, and/or blocking the perforation.

Generating the fluid plug within the perforated section of the production casing at 350 may include increasing a viscosity of the sealing fluid to generate the fluid plug. As used herein the phrase "increasing a viscosity of the sealing fluid" may include increasing a resistance to flow of the sealing fluid within the casing conduit, increasing a resistance to flow of the sealing fluid through the perforation, and/or increasing a resistance to and/or preventing flow of another fluid and/or material past the sealing fluid within the casing conduit. This may include gelling the sealing fluid within the perforated section of the production casing, polymerizing the sealing fluid within the perforated section of the production casing, cross-linking the sealing fluid within the perforated section of the production casing, chemically reacting the sealing fluid within the perforated section of the production casing, at least partially solidifying the sealing fluid within the perforated section of the production casing, and/or completely solidifying the sealing fluid within the perforated section of the production casing.

Retaining the sealing device with the fluid plug at 355 may include retaining the sealing device proximate to and/or on the perforation with the fluid plug. As illustrative, non-exclusive examples, the retaining at 355 may include immobilizing, or at least substantially immobilizing, the sealing device within the fluid plug. This may include retaining the sealing device proximate, in contact with, on, and/or in a sealed configuration on a corresponding perforation.

As another illustrative, non-exclusive example, and as discussed herein, the retaining at 355 may include retaining the sealing device on the perforation even when a magnitude of a pressure within the casing conduit is less than a threshold pressure below which the sealing device would not remain on the perforation without the presence of the fluid plug, even when a pressure differential between the casing conduit and the subterranean formation is less than a threshold pressure differential below which the sealing device would not remain on the perforation without the presence of the fluid plug, and/or when the magnitude of the pressure differential is insufficient to retain the sealing device on the perforation.

As an illustrative, non-exclusive example, and subsequent to the generating at 350, methods 300 further may include removing the perforation device from the casing conduit, and the retaining at 355 may include retaining the sealing device proximate to and/or on the perforation with the fluid plug while the perforation device is removed from the casing conduit. As another illustrative, non-exclusive example, the retaining at 355 may include retaining the sealing device on the perforation during a malfunction of the stimulation assembly, such as may be detected during the determining at 305.

It is within the scope of the present disclosure that the retaining at 355 may include retaining for any suitable retention time, which also may be referred to herein as a threshold sealing time of the fluid plug. As illustrative, non-exclusive examples, the retention time may be at least 2 hours, at least 3 hours, at least 4 hours, at least 5 hours, at least 6 hours, at least 7 hours, at least 8 hours, at least 9 hours, or at least 10 hours. Additionally or alternatively, the retention time also may be less than 24 hours, less than 22 hours, less than 20 hours, less than 18 hours, less than 16 hours, less than 14 hours, less than 12 hours, less than 10 hours, less than 8 hours, or less than 6 hours.

As another illustrative, non-exclusive example, the retention time may be selected based, at least in part, on a length of time needed to perform one or more steps of methods 300. As an illustrative, non-exclusive example, the retention time may be any suitable predetermined and/or preselected length of time. As additional illustrative, non-exclusive examples, the retention time may be based, at least in part, on a length of time that is needed remove the perforation device from the casing conduit, a length of time that is needed to locate the perforation device within the casing conduit, and/or a length of time that is needed to perform the creating at 315, the providing at 320, the stimulating at 325, the providing at 330, the providing at 335, the flowing at 340, the locating at 345, and/or the generating at 350. This may include adding any suitable buffer time to any suitable one of and/or any suitable sum of the above-listed times.

Breaking the fluid plug at 360 may include decreasing the viscosity of the fluid plug, ceasing the retaining at 355, and/or permitting, or initiating, flow of the fluid plug within the casing conduit and may be accomplished in any suitable manner. As an illustrative, non-exclusive example, and as discussed herein, a composition of the fluid plug may be selected such that the fluid plug automatically breaks, breaks down, decays, and/or decreases in viscosity after a threshold sealing time, illustrative, non-exclusive examples of which are disclosed herein. Thus, the breaking at 360 may include passively breaking the fluid plug. Additionally or alternatively, the breaking at 360 also may include actively breaking the fluid plug, such as through supply of, release of, and/or remote release of a breaking compound, which is selected to produce the breaking at 360, to the casing conduit and/or into contact with the fluid plug. As an illustrative, non-exclusive example, the breaking compound may be flowed into the casing conduit from the surface region. As another illustrative, non-exclusive example, the breaking compound may be located within but fluidly isolated from the fluid plug during formation of the fluid plug (such as by being contained within a carrier). Under these conditions, the breaking compound may be released into the fluid plug after the threshold sealing time (such as by degradation of the carrier) and/or may be remotely released into the fluid plug (such as through the use of a carrier that includes a remotely actuated release mechanism).

Repeating at least a portion of the methods at 365 may include repeating any suitable portion of methods 300. As an illustrative, non-exclusive example, the perforated section of the production casing may be a first perforated section of the production casing that includes a first perforation, and the repeating at 365 may include repeating the creating at 315 within, or to create, a second, or subsequent, perforation in a second, or subsequent, perforated section of the production casing. As another illustrative, non-exclusive example, the portion of the subterranean formation may be a first portion of the subterranean formation that includes a first stimulated region (or a first fracture), and the repeating at 365 may include repeating the providing at 320 and the stimulating at 325 to generate a second stimulated region (or a second fracture) within a second, or subsequent, portion of the subterranean formation.

As another illustrative, non-exclusive example, the sealing device may be a first sealing device, and the repeating at 365 may include repeating the providing at 335, the flowing at 340, and the locating at 345 to locate a second sealing device on the second perforation. As yet another illustrative, non-exclusive example, the fluid plug may be a first fluid plug, and the repeating at 365 may include repeating the providing at 330 and the generating at 350 to generate a second, or subsequent, fluid plug within the casing conduit and/or within the second perforated section of the production casing.

As an illustrative, non-exclusive example, the repeating at 365 may include repeating the creating at 315 to create the second perforation within the second perforated section of the production casing, with the second perforated section of the production casing being uphole from the first perforated section of the production casing. This may include repeating the creating at 315 subsequent to and/or concurrently with the retaining at 355.

As another illustrative, non-exclusive example, repeating the creating at 315 may include repeating during a perforating period (or a perforating time period), and the retaining at 355 may include retaining the sealing device for a retaining period (or a retaining time period) that is greater than the perforating period. As illustrative, non-exclusive examples, the retaining period may be at least 2 times, at least 3 times, at least 4 times, at least 5 times, at least 6 times, at least 7 times, at least 8 times, at least 9 times, or at least 10 times longer than the perforating period.

As yet another illustrative, non-exclusive example, the repeating at 365 may include repeating methods 300 a plurality of times during the threshold sealing time of the first fluid plug and/or prior to breaking the first fluid plug at 360. As illustrative, non-exclusive examples, the repeating may include repeating at least 2 times, at least 3 times, at least 4 times, at least 5 times, at least 6 times, at least 7 times, at least 8 times, at least 9 times, or at least 10 times.

Figure 10:
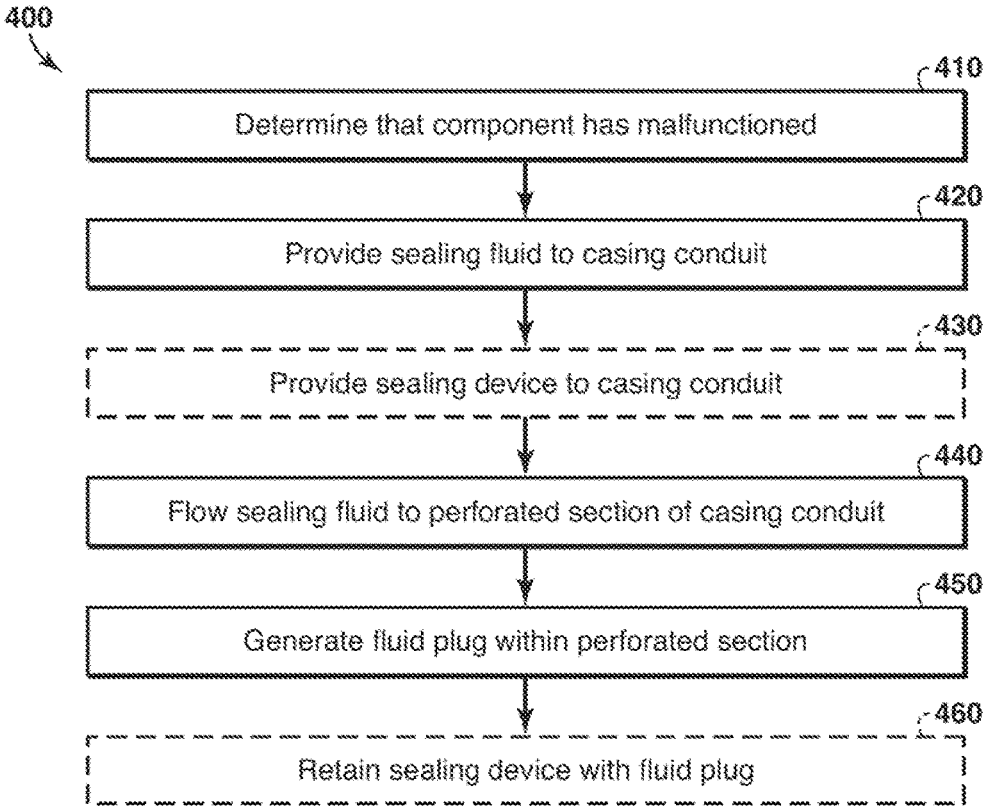
FIG. 10 is a flowchart depicting methods according to the present disclosure of responding to a malfunction of a stimulation assembly that is configured to stimulate a subterranean formation.

FIG. 10 is a flowchart depicting methods 400 according to the present disclosure of responding to a malfunction of a stimulation assembly that is configured to stimulate a subterranean formation. Methods 400 include determining that a component of the stimulation assembly has malfunctioned at 410 and providing, at 420, a sealing fluid to a casing conduit of a production casing that extends within the subterranean formation. Methods 400 further may include providing a sealing device to the casing conduit at 430 and flowing the sealing fluid to a perforated section of the production casing that includes a perforation at 440. Methods 400 further include generating a fluid plug within the perforated section of the production casing at 450 and may include retaining the sealing device with the fluid plug at 460.

Determining that the component of the stimulation assembly has malfunctioned at 410 may include determining that one or more components of the stimulation assembly has malfunctioned and/or is not operating as designed and/or as expected. Illustrative, non-exclusive examples of the components of the stimulation assembly are discussed herein, and the determining at 410 may be at least substantially similar to the determining at 305 that is discussed herein with reference to methods 300 of FIG. 9.

Providing, at 420, the sealing fluid to the casing conduit may include providing any suitable sealing fluid, illustrative, non-exclusive examples of which are disclosed herein, to the casing conduit. The providing at 420 may be at least substantially similar to the providing at 330 that is discussed herein with reference to methods 300 of FIG. 9.

Providing the sealing device to the casing conduit at 430 may include providing any suitable sealing device, illustrative, non-exclusive examples of which are discussed herein, to the casing conduit. The providing at 430 may be initiated responsive to the determining at 410 and/or responsive to the providing at 420. Additionally or alternatively, the providing at 430 also may be performed at least partially concurrently with the providing at 420 and/or with the flowing at 440.

Additionally or alternatively, the providing at 430 also may include flowing the sealing device to the perforated section of the production casing and/or locating the sealing device on the perforation. This may be at least substantially similar to the flowing at 340 and/or to the locating at 345 that are discussed herein with reference to methods 300 of FIG. 9.

Flowing the sealing fluid to the perforated section of the production casing 440 may include flowing the sealing fluid within the casing conduit and to the perforated section of production casing. The flowing at 440 may be at least substantially similar to the flowing at 340 that is discussed herein with reference to methods 300 of FIG. 9.

Generating the fluid plug within the perforated section of the production casing at 450 may include generating the fluid plug by increasing a viscosity of the sealing fluid while the sealing fluid is within the perforated section of the production casing. The generating at 450 may be at least substantially similar to the generating at 350 that is discussed herein with reference to methods 300 of FIG. 9.

Retaining the sealing device with the fluid plug at 460 may include retaining the sealing device proximate, near, and/or on the perforation with the fluid plug. The retaining at 460 may be at least substantially similar to the retaining at 355 that is discussed herein with reference to methods 300 of FIG. 9.

In the present disclosure, several of the illustrative, non-exclusive examples have been discussed and/or presented in the context of flow diagrams, or flow charts, in which the methods are shown and described as a series of blocks, or steps. Unless specifically set forth in the accompanying description, it is within the scope of the present disclosure that the order of the blocks may vary from the illustrated order in the flow diagram, including with two or more of the blocks (or steps) occurring in a different order and/or concurrently. It is also within the scope of the present disclosure that the blocks, or steps, may be implemented as logic, which also may be described as implementing the blocks, or steps, as logics. In some applications, the blocks, or steps, may represent expressions and/or actions to be performed by functionally equivalent circuits or other logic devices. The illustrated blocks may, but are not required to, represent executable instructions that cause a computer, processor, and/or other logic device to respond, to perform an action, to change states, to generate an output or display, and/or to make decisions.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

In the event that any patents, patent applications, or other references are incorporated by reference herein and define a term in a manner or are otherwise inconsistent with either the non-incorporated portion of the present disclosure or with any of the other incorporated references, the non-incorporated portion of the present disclosure shall control, and the term or incorporated disclosure therein shall only control with respect to the reference in which the term is defined and/or the incorporated disclosure was originally present.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

INDUSTRIAL APPLICABILITY

The systems and methods disclosed herein are applicable to the oil and gas industry.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

The invention claimed is:

1. A method of stimulating a subterranean formation, the method comprising:

providing a stimulating fluid to a casing conduit that is defined by a production casing that extends within the subterranean formation;

stimulating a portion of the subterranean formation with the stimulating fluid;

providing a sealing fluid to the casing conduit, wherein a composition of the sealing fluid is different from a composition of the stimulating fluid;

providing a sealing device to the casing conduit;

flowing the sealing fluid and the sealing device to a perforated section of the production casing;

locating the sealing device on a perforation that is present within the perforated section of the production casing to at least partially seal the perforation;

generating a fluid plug within the perforated section of the production casing by increasing a viscosity of the sealing fluid sufficient to suspend the sealing device therein for a threshold sealing time;

retaining the sealing device proximate the perforation with the fluid plug by suspending the sealing device within the fluid plug; and degrading the fluid plug viscosity subsequent to expiration of the threshold sealing time and flowing the sealing device out of the perforated section of the production casing.

2. The method of claim 1, wherein the method further includes creating the perforation in the perforated section of the production casing to provide fluid communication between the subterranean formation and the casing conduit.

3. The method of claim 2, wherein, prior to creating the perforation, the method includes locating a perforation device within the production casing, wherein the creating a perforation includes perforating the production casing with the perforation device.

4. The method of claim 2, wherein the method includes providing the stimulating fluid to the casing conduit prior to the creating a perforation, wherein the providing the stimulating fluid includes increasing a fluid pressure within the casing conduit, wherein the method further includes determining that the fluid pressure within the casing conduit is greater than a threshold fluid pressure, and further wherein the creating a perforation includes creating the perforation responsive to the fluid pressure being greater than the threshold fluid pressure.

5. The method of claim 2, wherein the method includes repeating the method a plurality of times to:

create a plurality of perforations in a plurality of perforated sections of the production casing;

stimulate a plurality of portions of the subterranean formation;

locate a respective sealing device of a plurality of sealing devices on each of the plurality of perforations; and retain the plurality of sealing devices on the plurality of perforations with a plurality of fluid plugs.

6. The method of claim 5, wherein the method includes continuously providing at least one of the stimulating fluid and the sealing fluid to the casing conduit during at least 75% of a time period during which the method is performed.

7. The method of claim 1, wherein the providing the sealing fluid includes providing the sealing fluid subsequent to the providing the stimulating fluid.

8. The method of claim 1, wherein the providing the sealing fluid includes providing the sealing fluid concurrently with the providing the sealing device.

9. The method of claim 1, wherein the flowing includes flowing the sealing fluid at least partially concurrently with flowing the sealing device.

10. The method of claim 1, wherein the generating the fluid plug includes resisting fluid flow through the perforated section of the production casing with the fluid plug.

11. The method of claim 1, wherein the providing the sealing fluid includes providing a volume of the sealing fluid to the casing conduit, and wherein the method further includes timing the providing a sealing fluid and the providing a sealing device such that only less than 25% of the volume of the sealing fluid flows through the perforation prior to the generating.

12. The method of claim 1, wherein the providing the sealing fluid includes providing a volume of the sealing fluid to the casing conduit, and wherein the method further includes timing the providing a sealing fluid and the providing a sealing device such that at least 0.1%, but not all, of the volume of the sealing fluid flows through the perforation prior to the generating.

13. The method of claim 1, wherein the retaining includes at least substantially immobilizing the sealing device within the fluid plug.

14. The method of claim 1, wherein the method further includes removing a perforation device from the casing conduit, and further wherein the retaining includes retaining the sealing device proximate the perforation while the perforation device is removed from the casing conduit.

15. The method of claim 1, wherein the retaining includes increasing the viscosity of the fluid plug sufficiently to retain the sealing device proximate the perforation against a pressure differential that would unseat the sealing device on the perforation if the fluid plug were not present.

16. The method of claim 1, wherein the retaining includes retaining the sealing device proximate the perforation for at least 4 hours and less than 24 hours.

17. The method of claim 1, wherein the method further includes breaking the fluid plug.

18. The method of claim 1, wherein the sealing fluid includes a crosslinking gel solution.

19. The method of claim 1, wherein the fluid plug defines a fluid plug length that is defined along a longitudinal axis of the fluid plug, wherein the fluid plug length is at least 20 m and less than 250 m.

20. The method of claim 1, further comprising producing hydrocarbons from the stimulated portion of the subterranean formation.

21. A method of responding to a malfunction of a stimulation assembly that is configured to stimulate a subterranean formation, the method comprising:

determining that at least one component of the stimulation assembly has malfunctioned;

providing a sealing fluid to a casing conduit of a production casing that extends within the subterranean formation responsive to the determining;

providing a sealing device to the casing conduit responsive to the determining;

flowing the sealing fluid to a perforated section of the production casing that includes a perforation;

generating a fluid plug within the perforated section of the production casing by increasing a viscosity of the sealing fluid sufficient to retain the provided sealing device proximate the perforation with the generated fluid plug for a threshold sealing time; and degrading the fluid plug viscosity subsequent to expiration of the threshold sealing time and flowing the sealing device out of the perforated section of the production casing.

22. The method of claim 21, wherein the retaining includes retaining the sealing device proximate the perforation for a threshold sealing time of at least 2 hours and less than 24 hours.

23. A hydrocarbon well, comprising:

a wellbore that extends within a subterranean formation;

a production casing that extends within the wellbore, wherein the production casing includes a perforated section that includes a perforation; a ball sealer that is located proximate the perforation to at least partially seal the perforation; and a fluid plug that is at least partially generated within the perforated section of the production casing, the fluid plug being generated by increasing a viscosity of a sealing fluid until the sealing fluid has a viscosity sufficient to suspend the provided ball sealer therein for a threshold sealing time, wherein the fluid plug is in contact with the ball sealer and the fluid plug viscosity retains the ball sealer proximate the perforation; and the viscosity of the fluid plug is degraded subsequent to expiration of the threshold sealing time and the ball sealer is flowed out of the perforated section of the production casing.

24. The well of claim 23, further comprising hydrocarbons produced from the subterranean formation.

25. The well of claim 23, wherein the perforated section is a first perforated section, wherein the perforation is a first perforation, wherein the ball sealer is a first ball sealer, wherein the fluid plug is a first fluid plug, and further wherein the production casing includes a plurality of perforated sections, wherein each perforated section of the plurality of perforated sections includes a respective perforation of a plurality of perforations, wherein the well further includes a plurality of ball sealers, wherein a respective ball sealer of the plurality of ball sealers is located on each perforation of the plurality of perforations, and further wherein the well includes a plurality of fluid plugs, wherein a respective fluid plug of the plurality of fluid plugs is located within each perforated section of the plurality of perforated sections and retains the respective ball sealer on the respective perforation.

26. The well of claim 25, wherein each fluid plug of the plurality of fluid plugs is formed from a sealing fluid that includes a crosslinking gel solution.

* * * * *